US010422335B2

(12) United States Patent
Clements

(10) Patent No.: US 10,422,335 B2
(45) Date of Patent: Sep. 24, 2019

(54) INTEGRATED PRESSURE PLATE AND PORT PLATE FOR PUMP

(71) Applicant: EATON CORPORATION, Cleveland, OH (US)

(72) Inventor: Martin A. Clements, North Royalton, OH (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 87 days.

(21) Appl. No.: 15/315,245

(22) PCT Filed: May 27, 2015

(86) PCT No.: PCT/US2015/032710
§ 371 (c)(1),
(2) Date: Nov. 30, 2016

(87) PCT Pub. No.: WO2015/183980
PCT Pub. Date: Dec. 3, 2015

(65) Prior Publication Data

US 2017/0101988 A1 Apr. 13, 2017

Related U.S. Application Data

(60) Provisional application No. 62/005,137, filed on May 30, 2014.

(51) Int. Cl.
*F04C 2/34* (2006.01)
*F04C 14/18* (2006.01)
(Continued)

(52) U.S. Cl.
CPC ..... *F04C 2/3441* (2013.01); *F04C 2/34* (2013.01); *F04C 14/18* (2013.01); *F04C 28/18* (2013.01);
(Continued)

(58) Field of Classification Search
CPC ..... F04C 2230/91; F04C 2230/92; F04C 2240/30; F04C 2270/16
See application file for complete search history.

(56) References Cited

U.S. PATENT DOCUMENTS 5,190,450 A 3/1993 Ghosh et al.
2003/0091835 A1* 5/2003 Takahashi ..... C03C 17/007 428/432
(Continued)

FOREIGN PATENT DOCUMENTS

EP 1 245 821 A1 10/2002
WO WO 2001/06127 A1 1/2001

OTHER PUBLICATIONS

Machine translation of EP 1,245,821 A1, inventor: Schelhas et al, patent published on Oct. 2, 2002.*
(Continued)

*Primary Examiner* — Mary Davis
(74) *Attorney, Agent, or Firm* — Fay Sharpe LLP

(57) ABSTRACT

An integrated pressure plate and port plate, and method of forming same, for a pump includes a housing having a pumping chamber formed therein. The housing includes first and second metal pressure plate portions that form at least a portion of the pumping chamber wherein at least one of the first and second pressure plate portions has a hard coating formed of a different material than a remainder of the housing metal on a surface thereof where integrated ports are formed on surface(s) of the pressure plate portion(s). Surface irregularities relieve stresses and promote adhesion of the coating (e.g., tungsten carbide) to the underlying metal (aluminum alloy).

15 Claims, 4 Drawing Sheets

(51) Int. Cl.
*F04C 2/344* (2006.01)
*F04C 28/18* (2006.01)

(52) U.S. Cl.
CPC ..... *F04C 2230/91* (2013.01); *F04C 2230/92* (2013.01); *F04C 2240/30* (2013.01); *F04C 2270/16* (2013.01)

(56) References Cited

U.S. PATENT DOCUMENTS

2009/0098002 A1 4/2009 Coulas
2014/0295132 A1* 10/2014 Okazaki ..... C04B 41/89 428/116
2015/0322558 A1* 11/2015 Li ..... C23C 4/06 428/457

OTHER PUBLICATIONS www.EngineeringToolBox.com, Thermal Exapansion of common Metals, printed Jul. 22, 2018.*
PCT/US2015/032710, International Search Report and Written Opinion, dated Jul. 22, 2015.
EP 15 731 752.0 Communication from European Examination Division, dated Oct. 6, 2017.
EP 15 731 752.0 Communication from European Examination Division, dated Nov. 28, 2018.

* cited by examiner

INTEGRATED PRESSURE PLATE AND PORT PLATE FOR PUMP

This application claims the priority benefit of U.S. provisional application Ser. No. 62/005,137, filed May 30, 2014, the entire disclosure of which is incorporated herein by reference.

BACKGROUND

The present disclosure relates to a pump, pump assembly, or pump system, and an associated method of manufacturing same. It finds particular application in conjunction with a vane pump, however, it is to be appreciated that the present exemplary embodiment is also amenable to other like applications that encounter similar problems or require similar solutions.

In an exemplary vane pump, a pressure plate and port plate are two separate concentric components axially clamped and/or bolted together, for example, at several circumferentially spaced locations. The port plate is preferably constructed of tungsten carbide or a material with similar properties. The pressure plate is preferably constructed of aluminum alloy or a material with similar properties. Use of a lighter weight pressure plate constructed from aluminum alloy or similar material contributes to significant weight savings which is well known in the art.

The two port plates are axially spaced apart and define the pumping chamber therebetween, and also receive the cam ring, rotor, and vanes. Tungsten carbide is used due its wear resistance properties to minimize wear and tear from the movement of the rotor and vanes.

The interface of each of the pressure plates and associated port plates acts as a seal to limit the exposure of the high-pressure oil film trying to seep between the plates. To ensure effective sealing between the pressure plate and the port plate, it is paramount to provide a high degree of "flatness" to the port plate. Any compromise on the degree of flatness can lead to ineffective sealing and thereby cause more oil seeping in, which further causes pressure build-up between the interface of the pressure plate and the port plate leading to undesired deflection of the port plate. The deflection may cause the port plate to rub against the rotor and vanes which is undesirable and could lead to premature pump failure.

Consequently using a separate port plate and a separate pressure plate requires, for example,

- a finer degree of flatness for an effective seal between the port plate and mating pressure plate thus leading to higher machining costs;
- tighter deflection control of the port plate due to limit oil seeping in at the interface of the port plate and pressure plate potentially leading to rubbing against the rotor and vanes;
- use of a heavier port plate of tungsten carbide or a material with similar properties leads to higher overall pump weight and cost of machining the port plate; and
- lower reliability of the pump and potential premature pump failure due to one or more of the above reasons.

This disclosure remedies one or more of these problems in a simple, reliable, effective, and inexpensive manner.

BRIEF DESCRIPTION

There is provided a vane pump having an integrated pressure plate and port plate.

More specifically, the pump or pump assembly includes a housing having a pumping chamber formed therein. The housing includes first and second metal pressure plate portions that form at least a portion of the pumping chamber wherein at least one of the first and second pressure plate portions has a hard coating formed of a different material than a remainder of the housing metal on a surface thereof where integrated ports are formed on surface(s) of the pressure plate portion(s). A rotor, is received in the pumping chamber for rotation relative to the housing.

Preferably, each of the first and second pressure plate portions includes a hard coating that forms at least a portion of the pumping chamber.

In one embodiment, the coating is tungsten carbide.

The first and second pressure plate portions include surface irregularities to relieve stresses and promote adhesion of the coating to the underlying metal.

The housing in one preferred arrangement is an aluminum or aluminum alloy.

The pressure plate portions are axially spaced and form the pumping chamber therebetween.

The coating is provided at least in those regions of the pressure plate portions that include the integrated ports.

The metal and the coating have different coefficients of thermal expansion.

A method of forming a pump assembly includes providing a metal housing that forms an internal pumping chamber, coating at least a portion of the surface of the metal housing with a material different than the metal, and providing a rotor in the pumping cavity.

The coating step includes applying the coating on those surface portions of the housing that form the pumping chamber.

The method includes purposely forming surface irregularities in the metal housing to relieve stresses and enhance adhesion of the coating to the metal.

The coating step includes using a material that may have a different coefficient of thermal expansion than the pressure plate base metal.

The coating step preferably includes applying the coating in at least port areas of the housing that face the pumping chamber.

The applying step includes using tungsten carbide as the coating while the metal housing providing step includes forming the housing from aluminum or aluminum alloy.

A primary benefit of the integrated port and pressure plate construction is the elimination of interface related issues, including eliminating deflection criticality of the port plate(s) due to seeping of oil.

Another advantage is that the high cost of machining the port plate is eliminated.

The integrated port and pressure plate construction is light weight in comparison to existing assemblies.

With the integrated port and pressure plate construction, there is no need to bolt these components together.

Still another benefit is that cracks in the coating can be controlled and induced at desired locations to relieve stresses and adhere better to the surface.

Other advantages are associated with improved pump reliability and significantly increased pump life.

Still other benefits and advantages will become apparent those skilled in the art after reading and understanding the following detailed description.

DETAILED DESCRIPTION

Figure 1:
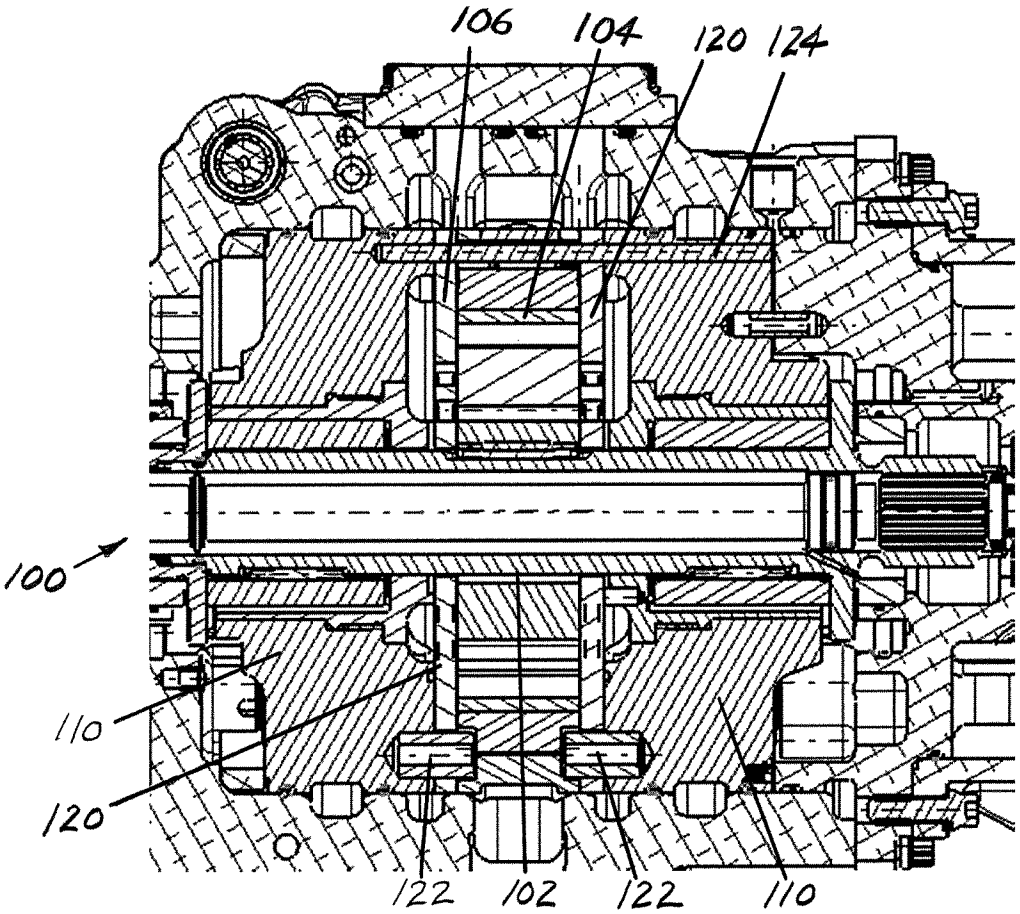
FIG. 1 is a cross-sectional view along a longitudinal axis of a prior art pump.
Figure 2:
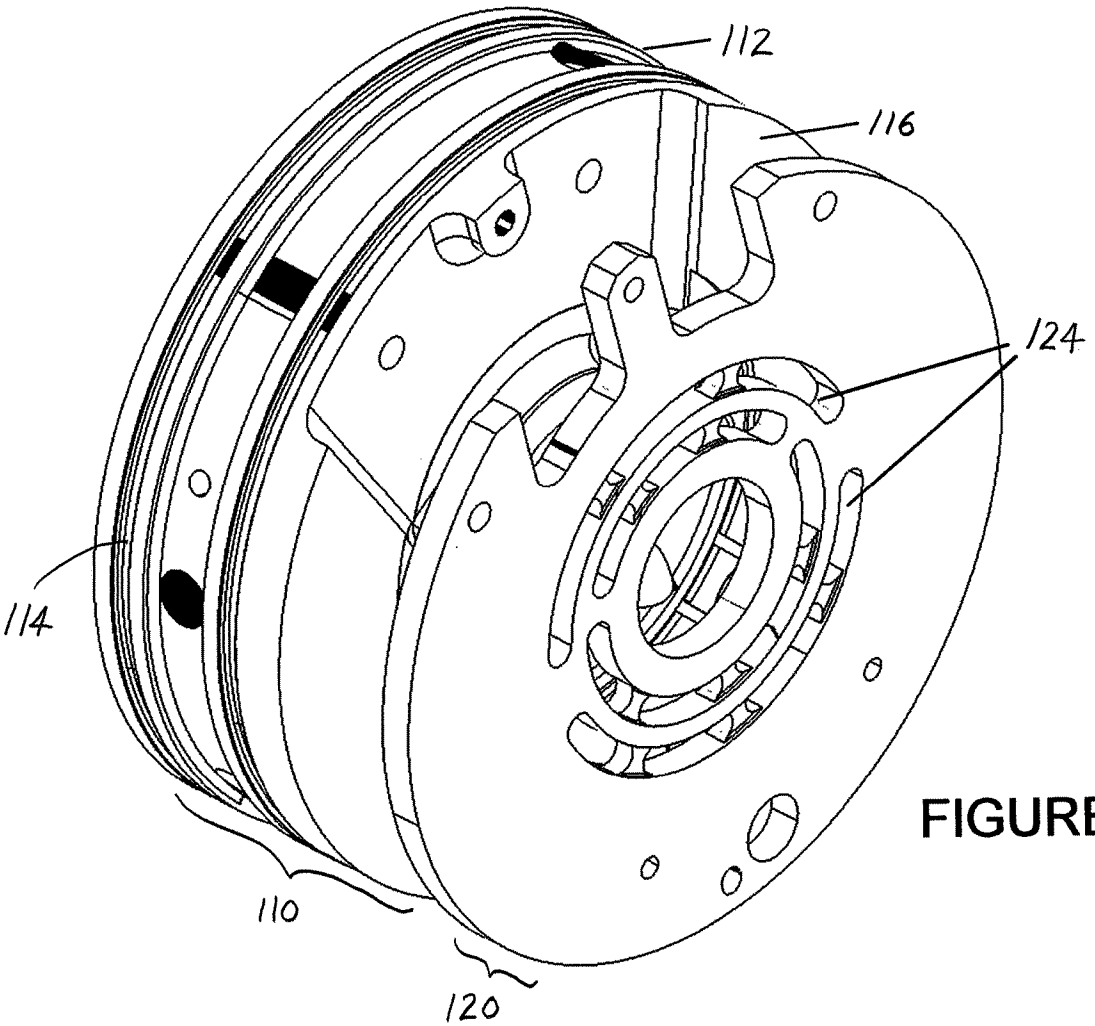
FIG. 2 is a perspective view of portions of the prior art pump of FIG. 1, namely a pressure plate and a port plate.

With reference to FIGS. 1 and 2, there is shown a pump 100, sometimes referred to as a vane pump or a variable displacement ring pump. Particular details of the structure and operation of such a pump 100 are well known to those skilled in the art so that further discussion herein is not required. Instead, those features that are the subject of the present disclosure are described in greater detail.

More particularly, FIG. 1 shows the pump 100 that includes a shaft 102 that drives rotor 104 received in a pumping chamber 106. Conventional pressure plates 110 are disposed on axially opposite ends of the pumping chamber 106. The pressure plates 110 are used in combination with the pair of port plates 120, and the individual plates are axially aligned and bolted together in a manner well known in the art, e.g. with fasteners such as bolts 122.

As briefly noted in the Background, it is common for portions of the pump housing, specifically the pressure plates 110, to be constructed of a light weight material such as aluminum or aluminum alloy, or a material having similar properties. On the other hand, the port plates 120 are oftentimes formed of a more expensive, durable or wear resistant material such as tungsten carbide or a material with similar properties. The port plates 120 and the interfacing surfaces of the pressure plates 110 must be flat or planar in order to provide for effective porting and sealing between the pressure plates 110 and the port plates 120, and likewise between the port plates and the pumping chamber 106. Providing a flat or planar port plate 120 provides for effective oil sealing between the port plate and the mating pressure plate 110. The hard, durable material of construction of the separate port plate 120 also resists deflection and potential interference or rubbing of the port plate with the rotor 104 or vanes. Unfortunately, this material of construction also leads to higher machining costs.

Thus, it is common to assemble port plates 120 so that inner surfaces thereof communicate with the pumping chamber 106 formed therebetween, and outer surfaces thereof abut against an associated pressure plate 110. The fasteners, e.g., bolts 122 hold the pressure plate 110 to the associated port plate 120, and also fasteners or bolts 124 are provided to extend axially and urge the pressure plates toward one another in the assembled structure. As perhaps best illustrated in FIG. 2, the pressure plate 110 in one arrangement has a generally circular outer surface or periphery 112, and opposite first or outer surface 114 and a second or inner surface 116. The inner surface 116 is configured for mating engagement with the separate port plate 120. The illustrated openings 124 extending through the port plate 120 represent ports that allow fluid therethrough for communication with the pumping chamber 106. Of course other porting configurations may be used without departing from the scope and intent of the present disclosure.

Figure 3:
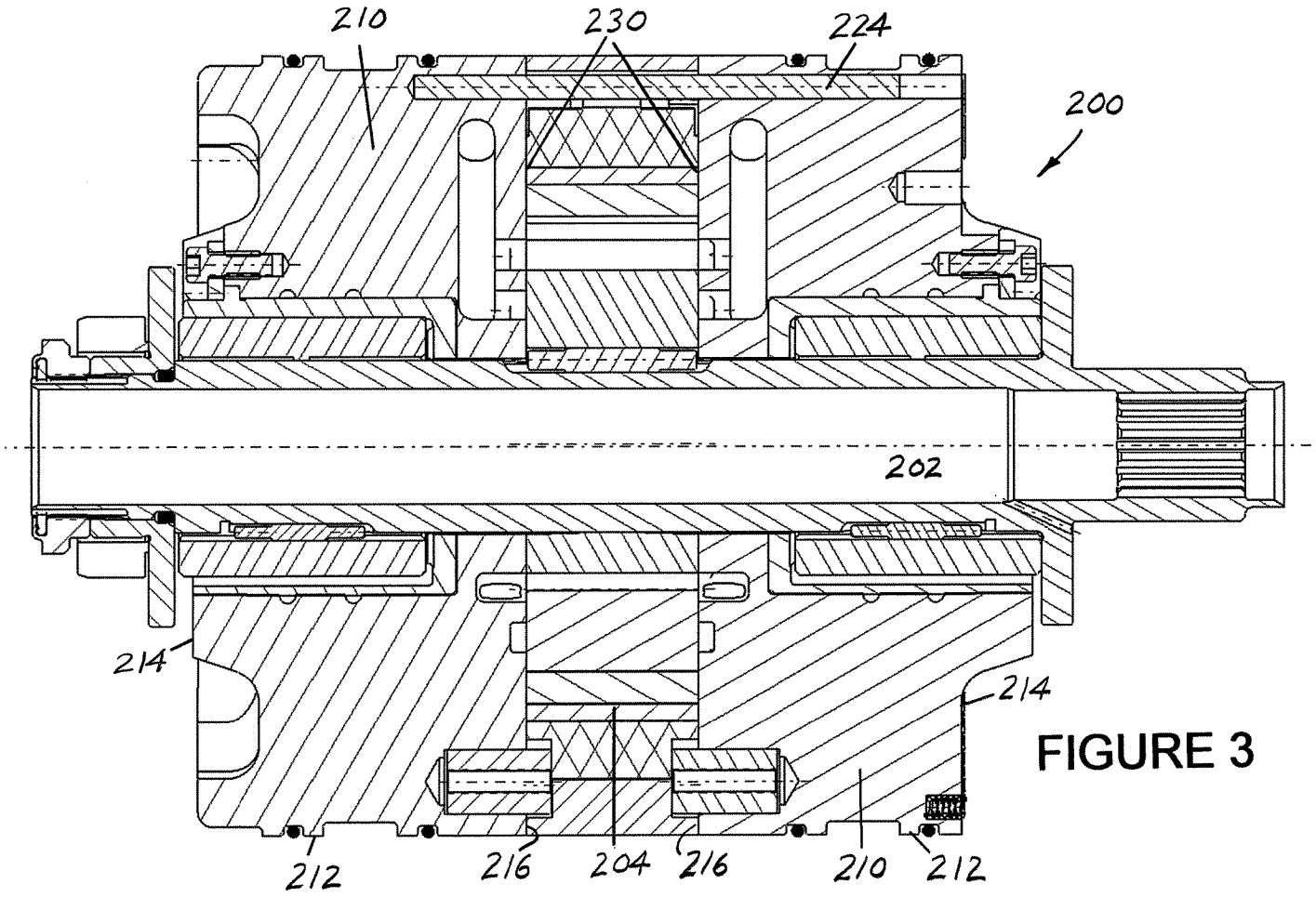
FIG. 3 is a cross-sectional view along the longitudinal axis of an integrated pressure plate/port plate pump structure of the present disclosure.
Figure 4:
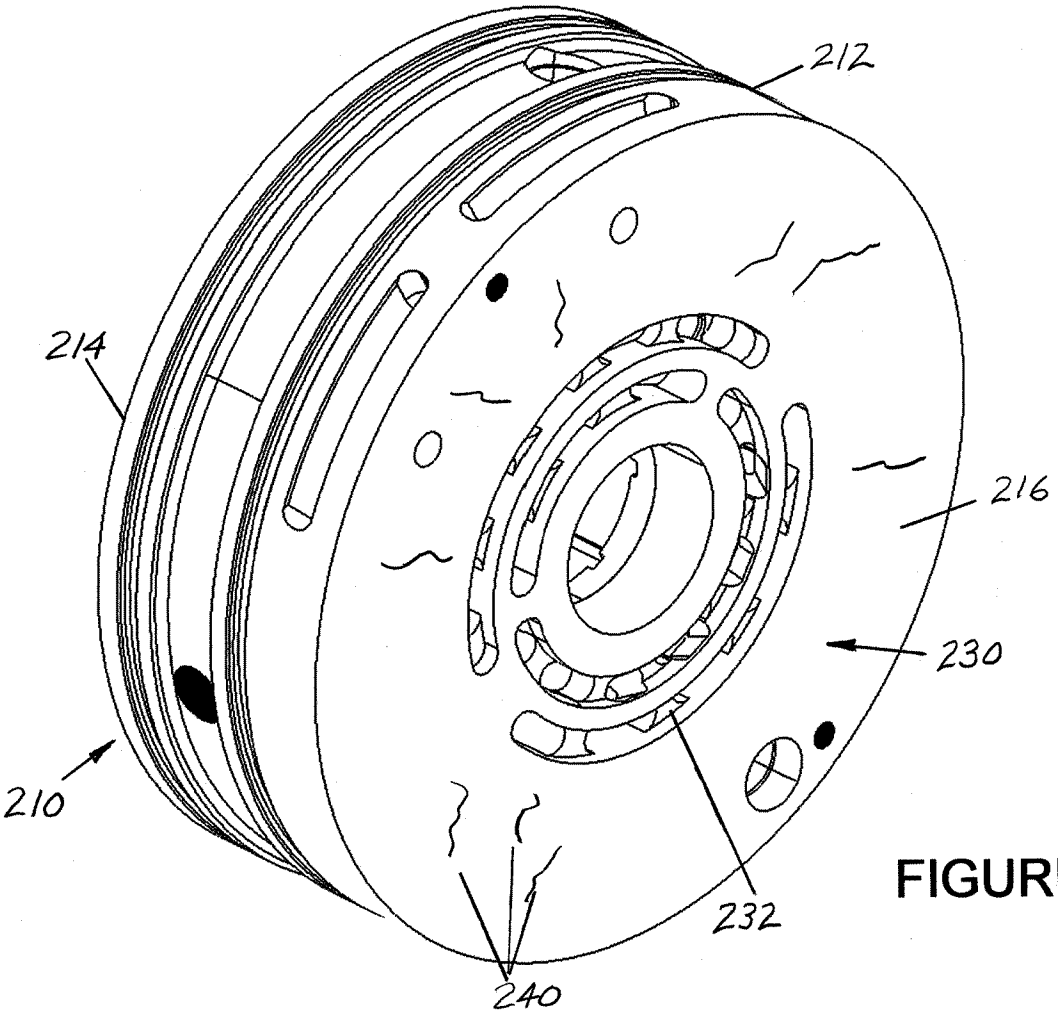
FIG. 4 is a perspective view of portions of the integrated pressure plate/port plate in the pump of FIG. 3.

In pump 200 of FIGS. 3 and 4 there are some similarities, as well as differences, when compared to the pump of FIGS. 1 and 2. A primary distinction is the elimination of separate port plates and the integration of the structure and operation of the omitted port plates into the modified pressure plates 210. More specifically, the pressure plate 210 has an outer perimeter 212, a first end face or surface 214, and a second end face or surface 216. The second surface 216 includes a coating 230 provided on portions or preferably all of the surface 216. Where the pressure plate 210 is still constructed of aluminum or aluminum alloy due to its light weight, the addition of openings or grooves 232 to form suitable ports is added to the pressure plate. The hard or wear resistant coating 230, such as tungsten carbide or another material exhibiting similar properties, is provided preferably over the entire surface 216, and at least in those regions around the ports 232. For example, the tungsten carbide coating 230 may be sprayed or otherwise applied to the inner surface 216 of the pressure plate 210.

The coating 230 (e.g. tungsten carbide) has a different coefficient of thermal expansion than the underlying metal (e.g., aluminum or aluminum alloy) of the pressure plate. As a result of the different coefficient of expansion associated with the coating 230 and the underlying pressure plate 210, there is a potential for cracking. Purposeful surface irregularities 240 (FIG. 4) are incorporated into the surface 216 to relieve stresses and allow the coating 230 to adhere better to the surface of the pressure plate 210. The surface irregularities 240 eliminate potential problems with cracking and/or delamination of the coating 230. Incorporating these features 240 into the machining of the uncoated pressure plate 210 act as crack location controls (e.g. similar to providing expansion joints and control locations in concrete). In this manner, greater control of the coating 230 on the pressure plate 210 is obtained, thereby allowing purposeful cracking at locations that have no adverse effect on the structure and operation of the integrated pressure plate/port plate 210, and assuring the enhanced adhesion of the coating in other areas where the wear resistant coating is more important. Likewise, one skilled in the art will appreciate that the surface irregularities 240 may adopt a wide variety of configurations from ridges and valleys, dimples, etc.

As a result, the integrated pressure plate/port plate 210 of FIGS. 3 and 4 has no interface related issues. The integrated plate 210 eliminates the problem of deflection of a separate port plate due to seeping of oil associated with the prior art structure. The higher cost for machining a separate port plate is also eliminated with the integrated structure. The integrated pressure and port plate 210 achieves lightweight construction comparison to the previous assembly of a separate pressure plate 110 and port plate 120. Bolting of a port plate 120 and pressure plate 110 is no longer required. Reduced machining costs are achieved, and additional weight is eliminated as well as elimination of oil seeping locations. The integrated plate 210 can be constructed of, for example, aluminum alloy with the thermal spray coating 230 at localized zones for desired surface properties. Cracks can be controlled and induced at a required location of the coating 230 to relieve stresses and better adhere the coating to the surface of the pressure plate 210.

This written description uses examples to describe the disclosure, including the best mode, and also to enable any person skilled in the art to make and use the disclosure. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims. Moreover, this disclosure is intended to seek protection for a combination of components and/or steps and a combination of claims as originally presented for examination, as well as seek potential protection for other combinations of components and/or steps and combinations of claims during prosecution.

What is claimed is:

1. A pump assembly comprising:

a housing having a pumping chamber formed therein;

the housing including first and second metal pressure plate portions that form at least a portion of the pumping chamber, wherein at least one of the first and/or second metal pressure plate portions has a hard coating on a surface thereof that is of a different material than a remainder of the metal of the at least one of the first and/or second metal pressure plate portions, integrated ports are formed in surfaces of the first and/or second metal pressure plate portions, wherein the first and second metal pressure plate portions include preselected surface irregularities only at locations that have no adverse effect on the structure and operation of the first and second metal pressure plate portion, the preselected irregularities relieve stresses and promote adhesion of the hard coating to the underlying metal; and a rotor received in the pumping chamber for rotation relative to the housing.

2. The pump assembly of claim 1 wherein the each of the first and second metal pressure plate portions includes the hard coating that forms at least a portion of the pumping chamber.

3. The pump assembly of claim 2 wherein the hard coating is tungsten carbide.

4. The pump assembly of claim 1 wherein the housing is an aluminum or aluminum alloy.

5. The pump assembly of claim 1 wherein the hard coating is tungsten carbide and the hard coating is provided at least in those regions of the at least one of the first and/or second metal pressure plate portions that include the integrated ports.

6. The pump assembly of claim 1 wherein the first and second metal pressure plate portions are axially spaced and form the pumping chamber therebetween.

7. The pump assembly of claim 6 wherein the hard coating is provided at least in those regions of the first and/or second metal pressure plate portions that include the integrated ports.

8. The pump assembly of claim 1 wherein the metal of the at least one of the first and/or second metal pressure plate portions and the hard coating have different coefficients of thermal expansion.

9. A method of forming a pump assembly comprising:

providing a metal housing that forms an internal pumping chamber;

coating at least a portion of the surface of the metal housing with a material different than the metal;

forming purposeful surface irregularities in the metal housing only at locations that have no adverse effect on the structure and operation of the pump assembly to relieve stresses and enhance adhesion of the coating to the metal; and providing a rotor in the pumping cavity.

10. The method of claim 9 wherein the surface coating step includes applying the coating on those surface portions of the housing that form the pumping chamber.

11. The method of claim 9 wherein the coating is tungsten carbide.

12. The method of claim 9 wherein the coating step includes using a material that has a different coefficient of thermal expansion than the metal.

13. The method of claim 9 wherein the coating step includes applying the coating in port areas of the housing that face the pumping chamber.

14. The method of claim 13 wherein the applying step includes using tungsten carbide as the coating.

15. The method of claim 14 wherein the metal housing providing step includes forming the housing from aluminum or aluminum alloy.

* * * * *